US005735005A

United States Patent [19]

Wang

[11] Patent Number: 5,735,005

[45] Date of Patent: Apr. 7, 1998

[54] MULTIFUNCTIONAL TOOL ASSEMBLY

[76] Inventor: Chih-chung Wang, No. 7, Alley 6, Lane 296, Pengyi Rd., Taiping Hsiang, Taichung Hsien, Taiwan

[21] Appl. No.: 683,955

[22] Filed: Jul. 19, 1996

[51] Int. Cl.[6] ..... B25B 7/22

[52] U.S. Cl. ..... 7/127; 7/126; 7/128; 7/129; 7/158; 7/165; 7/167

[58] Field of Search ..... 7/127, 128, 129, 7/126, 170, 118, 125, 132, 138, 142, 158, 165, 168; 81/177.4, 490, 427.5, 437–439

[56] References Cited

U.S. PATENT DOCUMENTS

| | | | |
|---|---|---|---|
| 254,631 | 3/1882 | Fisher | 7/127 |
| 886,202 | 4/1908 | Grasser | 7/138 |
| 2,057,201 | 10/1936 | McCluskey | 81/427.5 |
| 3,858,258 | 1/1975 | Stevens | 7/142 |
| 5,174,178 | 12/1992 | Disston, Jr. | 81/490 |
| 5,432,968 | 7/1995 | Beck | 7/127 |
| 5,460,063 | 10/1995 | Hodgson | 81/439 |
| 5,497,522 | 3/1996 | Chen | 7/128 |

*Primary Examiner*—James G. Smith
*Assistant Examiner*—Lee Wilson
*Attorney, Agent, or Firm*—Kerkam, Stowell, Kondracki & Clarke, P.C.; John C. Kerins

[57] ABSTRACT

A tool assembly is provided, which includes a primary body and a secondary body having a primary post and a secondary post respectively which are pivotally engaged with each other. An L-shaped primary flange is formed on an inner wall of the primary body and is located adjacent to the primary post, and a primary groove is defined in the primary post and is partially defined in the primary flange. An L-shaped secondary flange is formed on an inner wall of the secondary body and is located adjacent to the secondary post, and a secondary groove is defined in the secondary post and is partially defined in the secondary flange. A pair of pliers include two plier bodies pivotally engaged with each other and each having a shank received in each of the primary and secondary grooves and stopped by associated primary and secondary flanges.

12 Claims, 4 Drawing Sheets

MULTIFUNCTIONAL TOOL ASSEMBLY

FIELD OF THE INVENTION

The present invention relates to a multifunctional tool assembly.

BACKGROUND OF THE INVENTION

A conventional operating tool such as a pair of pliers contains a fixed structure and cannot be replaced by tools of an identical function when being worn out during long-term utilization, thereby greatly limiting the availability of the tool.

The present invention has arisen to mitigate and/or obviate the disadvantage of the conventional tool.

SUMMARY OF THE INVENTION

The primary objective of the present invention is to provide a tool assembly with multifunctions.

In accordance with one aspect of the present invention, there is provided a tool assembly comprising a primary body having a first end portion and a second end portion. A primary post extends from the first end portion of the primary body. An L-shaped primary flange is formed on an inner wall of the first end portion of the primary body and is located adjacent to the primary post. A primary groove is defined in the primary post and is partially defined in the primary flange.

A secondary body has a first end portion and a second end portion. A secondary post extends from the first end portion of the secondary body and is pivotally engaged with the primary post. An L-shaped secondary flange is formed on an inner wall of the first end portion of the secondary body and is located adjacent to the secondary post. A secondary groove is defined in the secondary post and is partially defined in the secondary flange.

A pair of pliers includes two plier bodies pivotally engaged with each other and each having a shank received in each of the primary and secondary grooves and stopped by means of associated primary and secondary flanges.

Further features of the present invention will become apparent from a careful reading of the detailed description with reference to the accompanying drawings.

DETAILED DESCRIPTION OF THE PREFERRED EMBODIMENTS

Figure 1:
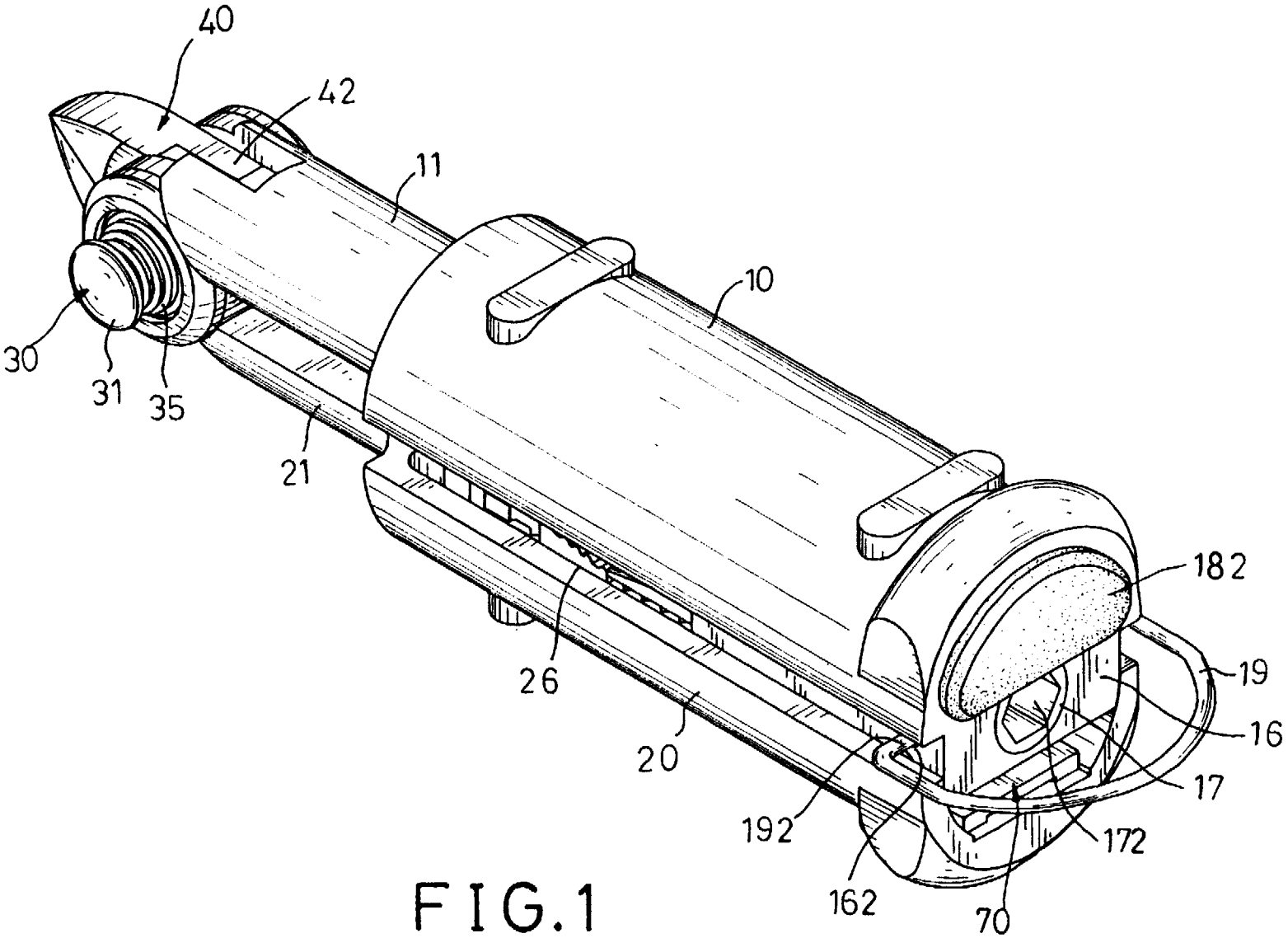
FIG. 1 is a perspective view of a multifunctional tool assembly in accordance with the present invention.
Figure 2:
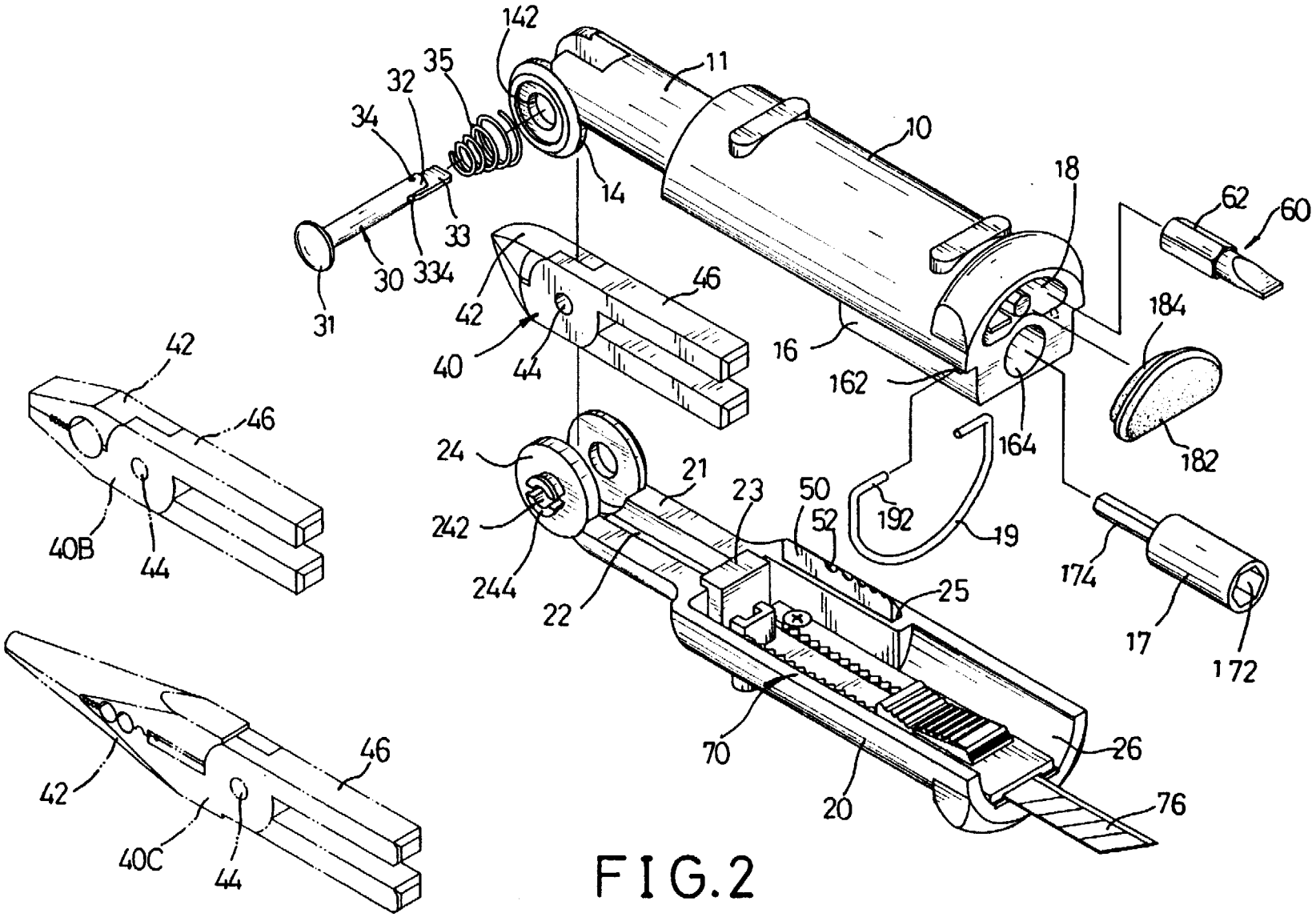
FIG. 2 is an exploded view of FIG. 1.
Figure 3:
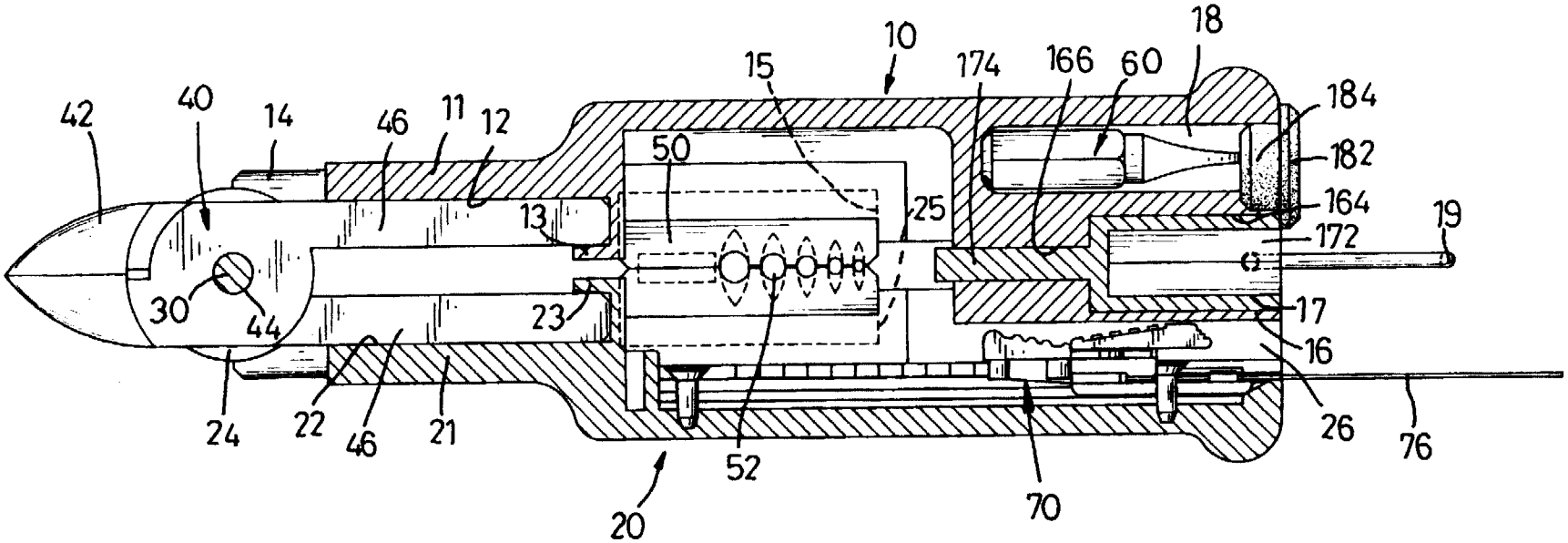
FIG. 3 is a front plan cross-sectional view of FIG. 1.

Referring to the drawings, and initially to FIGS. 2 and 3 with reference to FIG. 1, a multifunctional tool assembly in accordance with the present invention comprises primary body 10 having a first end portion and a second end portion. A primary post 11 extends from the first end portion of the primary body 10. An L-shaped primary flange 13 is formed on an inner wall of the first end portion of the primary body 10 and is located adjacent to the primary post 11. A primary groove 12 (FIG. 3) is defined in the primary post 11 and is partially defined in the primary flange 13.

A secondary body 20 has a first end portion and a second end portion. A secondary post 21 extends from the first end portion of the secondary body 20 and is pivotally engaged with the primary post 11. An L-shaped secondary flange 23 is formed on an inner wall of the first end portion of the secondary body 20 and is located adjacent to the secondary post 21. A secondary groove 22 is defined in the secondary post 21 and is partially defined in the secondary flange 23.

A pair of pliers includes two plier bodies 40 pivotally engaged with each other and each having a shank 46 received in each of the primary and secondary grooves 12 and 22 and stopped by means of an associated primary flange 13 and a secondary flange 23 such that the two shanks 46 of the pair of pliers can be pivoted relative to each other by means of a relative pivot movement of the two posts 11 and 21.

Each of the two plier bodies 40 preferably has a head 42 projecting outward of the two posts 11 and 21. Preferably, the pair of pliers may comprise different forms of plier bodies such as 40B and 40C as shown in phantom lines in FIG. 2.

Figure 4:
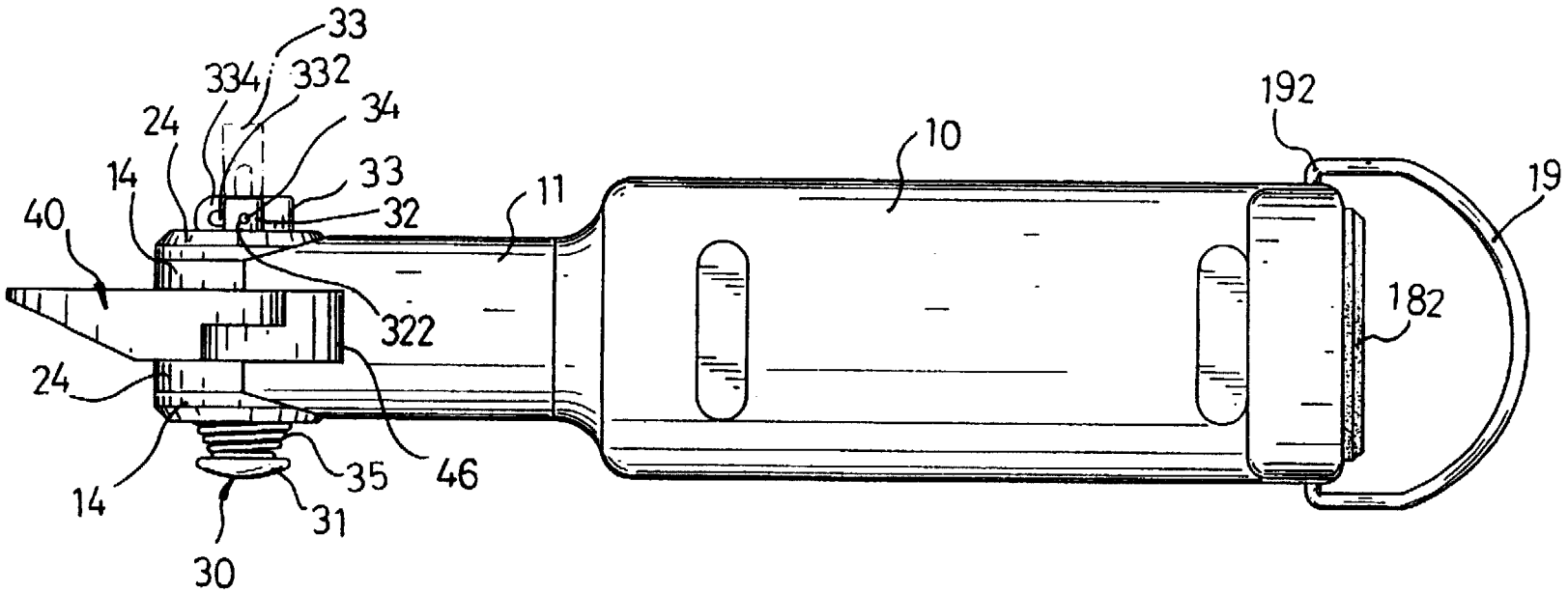
FIG. 4 is a top plan view of FIG. 1.

Referring to FIGS. 2 and 3 with reference to FIGS. 1 and 4, the primary post 11 includes two spaced primary ears 14 formed on a free end thereof and each having a primary hole 142 defined therein.

The secondary post 21 includes two spaced secondary ears 24 formed on a free end thereof and each juxtaposed to a corresponding one of the two primary ears 14. Each of the two secondary ears 24 has a secondary hole 242 defined therein and aligning with an associated primary hole 142. A lug 244 is laterally formed on one of the two secondary ears 24 and is received in the associated primary hole 142.

A retaining axle 30 extends through the primary and secondary holes 142 and 242 and through a bore 44 defined in the two plier bodies 40 such that the two posts 11 and 21 together with the two plier bodies 40 of the pair of pliers can be pivoted in concert and can be disengaged from each other easily.

By such an arrangement, the plier bodies 40 of the pair of pliers can be removed from the two posts 11 and 21 easily and can be replaced by plier bodies 40B or 40C of different forms when being required.

The retaining axle 30 preferably includes an enlarged head 31. A biasing member such as a spring 35 is mounted around the retaining axle 30 and is urged between one of the two primary ears 14 and the enlarged head 31.

Particularly referring to FIGS. 2 and 4, the retaining axle 30 includes a slotted free end 32 projecting outwards to one of the two secondary ears 24. A bore 322 is defined in the slotted free end 32.

A pivot member 33 is pivotally received in the slotted free end 32 and is rested on the associated secondary ear 24. An elongate slot 332 is defined in the pivot member 33 and communicates with the bore 322. A pin 34 extends through the bore 322 and the elongate slot 332 such that the pivot member 33 can be pivoted in the slotted free end 32. The pivot member 33 preferably has an arcuate end 334 received in the slotted free end 32.

In operation, the pivot member 33 can be urged to project outwards of the secondary post 24 by means of the retaining axle 30 as shown in phantom lines in FIG. 4 and can then be pivoted relative to the slotted end 32 to a position as shown in solid lines so as to abut against the secondary post 24. Then, the pivot member 33 can be pushed to move relative to the slotted end 32 with the pin 32 sliding in the elongate slot 332, thereby securing the pivot member 33 on the slotted end 32.

Again referring to FIGS. 2 and 3, the primary body 10 has a chamber 18 defined in the second end portion thereof. A cap 182 is mounted on the second end portion of the primary body 10 and has an insert 184 removably received in the chamber 18.

The primary body 10 includes a block 16 formed on the second end portion thereof and located beneath the chamber 18. A cylindrical channel 164 is defined in a first end of the block 16, and a hexagonal channel 166 is defined in a second end of the block 16 and communicates with the cylindrical channel 164.

A tubular sleeve 17 is received in the cylindrical channel 164, and a hexagonal rod 174 extends from the tubular sleeve 17 and is securely received in the hexagonal channel 166.

The tubular sleeve 17 has a hexagonal recess 172 defined therein. A plurality of driver heads 60 are each removably mounted in the chamber 18 and each have a hexagonal shank 62 which can be detachably mounted in the hexagonal recess 172.

A clip 19 is pivotally mounted on the block 16 and has two inward-facing free ends 192 each mounted in a respective cavity 162 defined in the block 16.

The secondary body 20 has an opening 26 defined therein, and a knife assembly 70 is adjustably received in the opening 26 and has a knife 76 slidably received in the opening 26.

The primary body 10 has a primary recess 15 defined therein, and the secondary body 20 has a secondary recess 25 defined therein and aligning with the primary recess 15. Two wire strippers 50 are each mounted in a corresponding one of the primary and secondary recesses 15 and 25 and each have a plurality of notches 52 for stripping wires when the two wire strippers 50 are pivoted to be coupled together.

It should be clear to those skilled in the art that further embodiments of the present invention may be made without departing from the scope and spirit of the present invention.

What is claimed is:

1. A tool assembly comprising:

a primary body having a first end portion and a second end portion, a primary post extending from the first end portion of said primary body, at least one primary ear formed on a free end of said primary post and defining a primary hole therein, an L-shaped primary flange formed on an inner wall of the first end portion of said primary body and located adjacent to said primary post, a primary groove defined in said primary post, partially defined in said primary flange;

a secondary body having a first end portion and a second end portion, a secondary post extending from the first end portion of said secondary body and pivotally engaged with said primary post, at least one secondary ear formed on a free end of said secondary post and juxtaposed to said primary ear, a secondary hole defined in said secondary ear and aligning with said primary hole a lug laterally formed on said secondary ear and received in said primary hole, an L-shaped secondary flange formed on an inner wall of the first end portion of said secondary body and located adjacent to said secondary post, a secondary groove defined in said secondary post and partially defined in said secondary flange, a retaining member extending through said primary and secondary holes and including a slotted free end projecting outwards of said secondary ear, a bore defined in said slotted free end;

a pivot member pivotally received in said slotted free end and rested on said secondary ear, an elongate slot defined in said pivot member and communicating with said bore;

a pin extending through said bore and said elongate slot; and a pair of pliers including two plier bodies pivotally engaged with each other and each having a shank received in each of said primary and secondary grooves and stopped by means of an associated said primary and secondary flanges.

2. The tool assembly in accordance with claim 1, wherein said retaining member includes an enlarged head, a biasing member mounted around said retaining member and urged between said primary ear and said enlarged head.

3. The tool assembly in accordance with claim 1, wherein said primary body defines a chamber in the second end portion thereof.

4. The tool assembly in accordance with claim 3, further comprising a cap mounted on the second end portion of said primary body and having an insert removably received in said chamber.

5. The tool assembly in accordance with claim 3, wherein said primary body includes a block formed on the second end portion thereof and located beneath said chamber, a circular channel defined in a first end of said block, a hexagonal channel defined in a second end of said block and communicating with said circular channel, a tubular sleeve received in said circular channel, a hexagonal rod extending from said tubular sleeve and received in said hexagonal channel.

6. The tool assembly in accordance with claim 5, wherein said tubular sleeve defines a hexagonal recess therein, and said tool assembly further has a plurality of driver heads each removably mounted in said chamber and each having a hexagonal shank detachably mounted in said hexagonal recess.

7. The tool assembly in accordance with claim 1, wherein said secondary body defines an opening therein, and wherein said tool assembly has a knife assembly adjustably received in said opening.

8. The tool assembly in accordance with claim 1, wherein said primary body defines a primary recess therein, said secondary body defines a secondary recess therein, and two wire strippers are each mounted in each of said primary and secondary recesses and align with each other.

9. A tool assembly comprising:

a primary body having a first end portion and a second end portion, a primary post extending from the first end portion of said primary body, an L-shaped primary flange formed on an inner wall of the first end portion of said primary body and located adjacent to said primary post, a primary groove defined in said primary post, partially defined in said primary flange;

a secondary body having a first end portion and a second end portion, a secondary post extending from the first end portion of said secondary body and pivotally engaged with said primary post, an L-shaped secondary flange formed on an inner wall of the first end portion of said secondary body and located adjacent to said secondary post, a secondary groove defined in said secondary post and partially defined in said secondary flange, a pair of pliers including two plier bodies pivotally engaged with each other and each having a shank received in each of said primary and secondary grooves and stopped by means of an associated said primary and secondary flanges, wherein said primary body defines a chamber in the second end portion thereof; and wherein said primary body includes a block formed on the second end portion thereof and located beneath said chamber, a circular channel defined in a first end of said block, a hexagonal channel defined in a second end of said block and communicating with said circular channel, a tubular sleeve received in said circular channel, a hexagonal rod extending from said tubular sleeve and received in said hexagonal channel.

10. The tool assembly in accordance with claim 9, wherein said tubular sleeve defines a hexagonal recess therein, and said tool assembly has a plurality of driver heads each removably mounted in said chamber and each having a hexagonal shank detachably mounted in said hexagonal recess.

11. The tool assembly in accordance with claim 9, wherein said secondary body defines an opening therein, and wherein said tool assembly has a knife assembly adjustably received in said opening.

12. The tool assembly in accordance with claim 9, wherein said primary body defines a primary recess therein, said secondary body defines a secondary recess therein, and two wire strippers are each mounted in each of said primary and secondary recesses and align with each other.

* * * * *